US006309262B1

(12) United States Patent
Morris

(10) Patent No.: US 6,309,262 B1
(45) Date of Patent: Oct. 30, 2001

(54) BIFURCATED CONTACT WITH A CONNECTING MEMBER AT THE TIP OF THE CONTACT THAT PROVIDES REDUNDANT CONTACT POINTS

(75) Inventor: Terrel L. Morris, Garland, TX (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/422,875

(22) Filed: Oct. 21, 1999

(51) Int. Cl.[7] ..... H01R 4/48
(52) U.S. Cl. ..... 439/862
(58) Field of Search ..... 439/862, 816, 439/891, 637, 80, 84, 83; 200/275, 284

(56) References Cited

U.S. PATENT DOCUMENTS

| | | | | |
|---|---|---|---|---|
| 3,131,017 | * | 4/1964 | Mittler | 439/862 |
| 3,382,575 | * | 5/1968 | Gannoe | 439/862 |
| 4,017,143 | * | 4/1977 | Knowles | 339/221 R |
| 4,317,609 | * | 3/1982 | Lapraik | 339/221 |
| 5,532,442 | * | 7/1996 | Lin | 200/16 C |

* cited by examiner

*Primary Examiner*—Gary Paumen
*Assistant Examiner*—Phuongchi Nguyen
(74) *Attorney, Agent, or Firm*—Steven L. Webb

(57) ABSTRACT

A connector with multiple redundant contact points is disclosed. The multiple redundant contacts are provided by a bifurcated contact with a joining member at the tip of the contact.

7 Claims, 5 Drawing Sheets

BIFURCATED CONTACT WITH A CONNECTING MEMBER AT THE TIP OF THE CONTACT THAT PROVIDES REDUNDANT CONTACT POINTS

RELATED APPLICATIONS

The application "A bifurcated contact with a connecting member that can add redundant contact points to single point connectors" that has the Ser. No. 09/422,813 is related to this application and is hereby incorporated by reference. The application "A connector with redundant contact points" that has the Ser. No. 09/422,879 is also related to this application and is hereby incorporated by reference. Both the above referenced applications were filed on the same day as this application.

FIELD OF THE INVENTION

The present invention relates generally to connectors and more specifically to an edge connector with multiple redundant contact points.

BACKGROUND OF THE INVENTION

Personal computers come with many standard features, however some features are not shipped with all personal computers. A user can add additional capabilities to a computer by installing additional printed circuit (PC) boards, (sometimes referred to as daughter cards) into the computer. These daughter cards are typically added by installing the daughter cards into edge connectors that are mounted on the main processor board (motherboard) of the personal computer. The daughter cards (102) typically have pads (104) along the edge of the board that make contact with the individual contacts (106) in the edge connector (108). These connections between the pads (104) on the daughter card and the contacts (106) in the edge connectors serve as the electrical connection between the computer motherboard and the daughter cards. The edge connectors make the electrical connection to the plated area, or pad (202), on the daughter card (208) by providing an exerting force (206) (sometimes referred to as the normal force) to the contact (204) to push the contact firmly against the pad (see FIG. 2). Unfortunately edge connectors have a number of problems that affect the reliability of the connections between the pads and the contact points in the edge connector.

One problem is that the pads on the daughter card can get dirty. This can affect the connection in two ways. First, the pads can be covered or splattered with a contaminant that forms a thin film. If the film is not displaced by a wiping action as the daughter card is inserted into the edge connector, the film can prevent the contact from touching the pad and making electrical connection with the pad. The amount of force or contact pressure between the pad and the contact point is a delicate balance between contact area and the normal force. When the contact area is relatively small with respect to the normal force, the contact pressure is high, and the contact can rip or wear plating from the surface of the pad. When the contact area is relatively large with respect to the normal force, the contact pressure is low, and the contact can fail to displace or wipe off the insulating surface contaminants, resulting in contact failure. Unacceptably high insertion force can result when a connector has a large number of contacts and a high normal force at each contact. Some edge connector applications, for example a test fixture, require a high number of insertion cycles over the life of the connector. In these applications a low normal force is desired to minimize the wear on the contacts and pads to extend the life of the connector. Today, typically a normal force of approximately 10 grams per contact is considered a low normal force and approximately 100 grams per contact is considered a high normal force.

Second, when the dirt on the daughter card is in the form of particles, the particles can wedge between the contact and the pad, lifting the contact away from the pad and preventing electrical connection to the pad. Other problems that can occur with edge connectors include plating defects on the pads, poor alignment of the contacts to the pads, and susceptibility to thermal changes, due to contact movement on the pad surface.

These problems are indicative of a common characteristic of edge card connectors, a single point of contact between the connector and the pad surface on the daughter card. This extremely small single point of contact can be rendered ineffective by plating defects, surface contamination, excessive wear, poor alignment, and motion. The result is that the entire interconnection can fail due to a small problem at a critical point. Making multiple redundant contacts between the connector and the plated surface of the daughter card can reduce these problems. By providing at least two contact points for each connector pin the chance that a random localized particle, film, dust or other contaminant will be able to cause a connector failure has been greatly reduced.

There are a number of ways that multiple redundant contacts can be implemented. One way is to send one signal to two different contacts connected to two different pads. This method can be used without any changes to current connector design. Unfortunately this method reduces the total number of signals that can be sent through the connector. If each signal were sent over two contacts the total number of signals that can be sent through the connector would be cut in half. Sending each signal to two different pads also increases the capacitance for each signal reducing the maximum operational frequency for the connector.

Another method to implement multiple redundant contacts is to cut the end of the contact into two prongs (see FIG. 3). This method creates two contact points (302) on the same pad. By creating two contact points on one pad the number of signals sent through the connector is not reduced. Multiple contacts on one pad also reduce the overall contact resistance. The multiple contacts form a parallel circuit and the resistance of parallel circuits is a function of the resistance per element, divided by the number of elements. Unfortunately when localized surface imperfections are present on the daughter card and one or both of the split contacts snag the imperfection during card insertion, locally high stresses can be inflicted into one or both of the split contacts. This can result in catastrophic contact failure and permanent damage to the connector. Because the connector manufacturer only makes the connector half of the mating pair of connector/daughter card, the connector manufacturer can not prevent this problem by controlling for surface imperfections of the daughter card.

Edge connectors are used in a wide variety of applications in addition to personal computers. The descriptions using personal computers as examples are for clarity of understanding and are not meant to limit the invention to edge connectors in personal computers. There is a need for a multiple redundant contact that can withstand surface imperfections during card insertion.

SUMMARY OF THE INVENTION

The present invention is a connector with multiple redundant contact points that can withstand surface imperfections during card insertion. The preferred embodiment comprises a bifurcated contact with a connecting member at the tip of the contact.

Other aspects and advantages of the present invention will become apparent from the following detailed description, taken in conjunction with the accompanying drawings, illustrating by way of example the principles of the invention.

DETAILED DESCRIPTION OF THE PREFERRED EMBODIMENT

Figure 1:
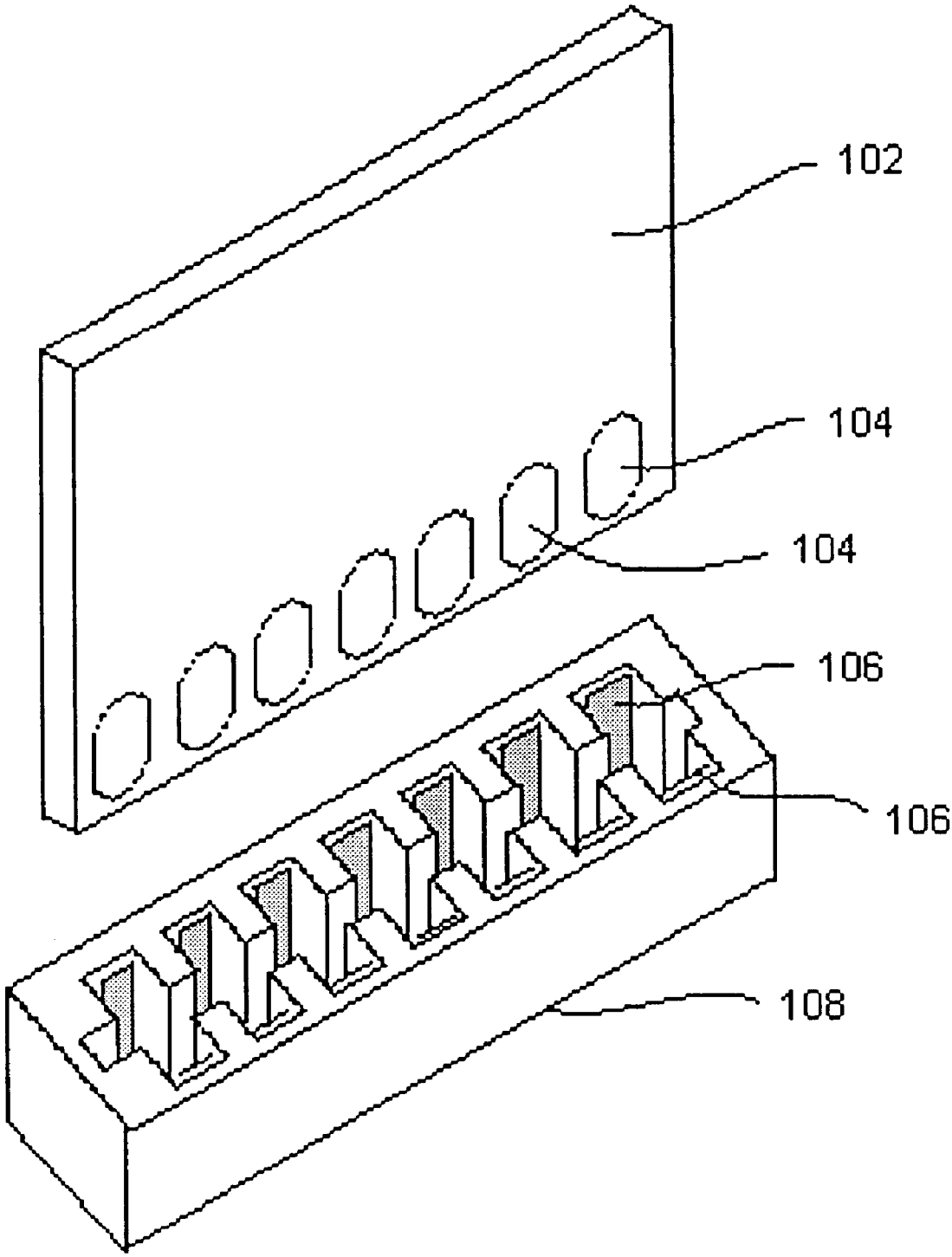
FIG. 1 is a projection view of an edge connector and a daughter card.
Figure 2:
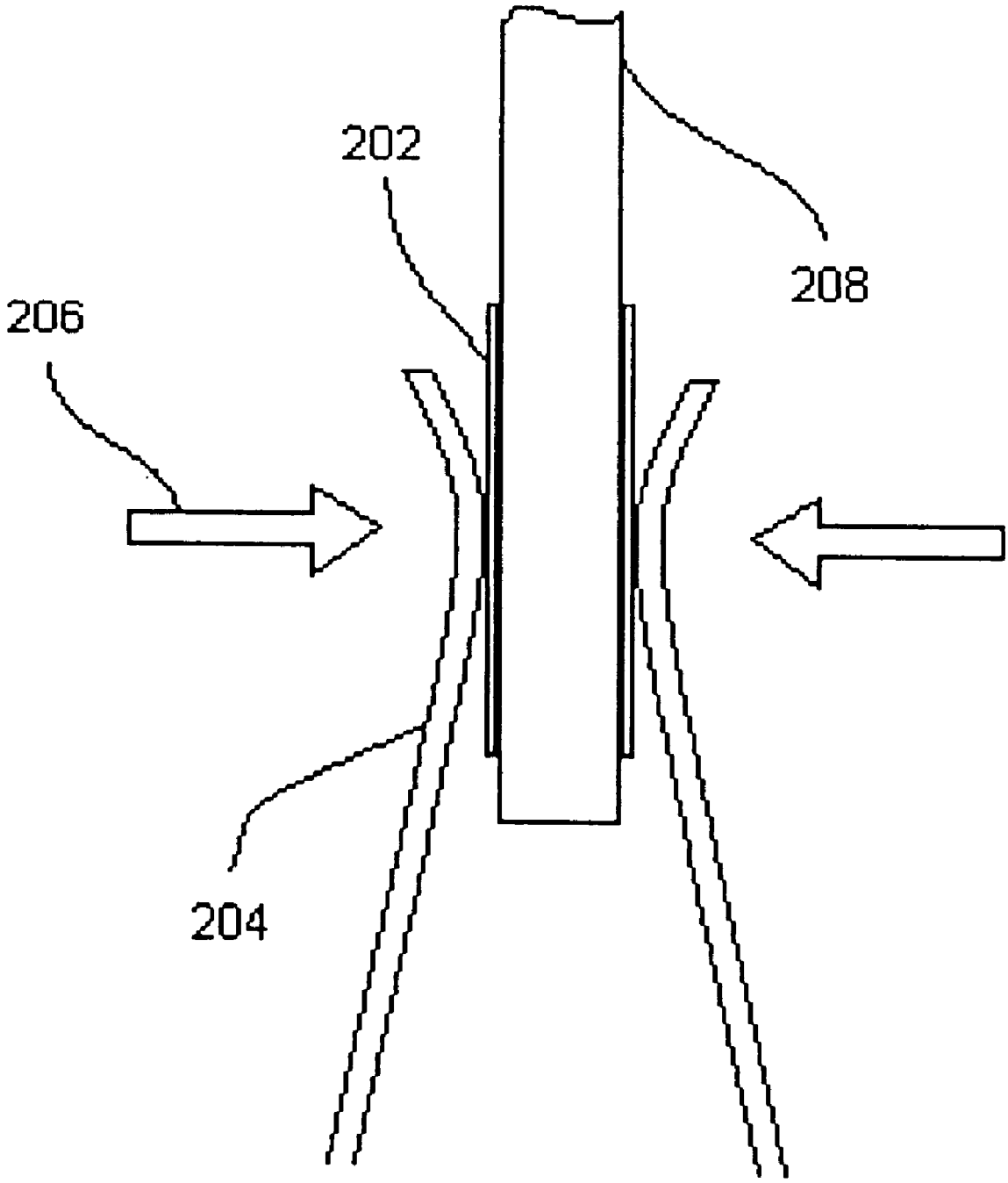
FIG. 2 is a force diagram of a daughter card inserted into an edge connector.
Figure 3:
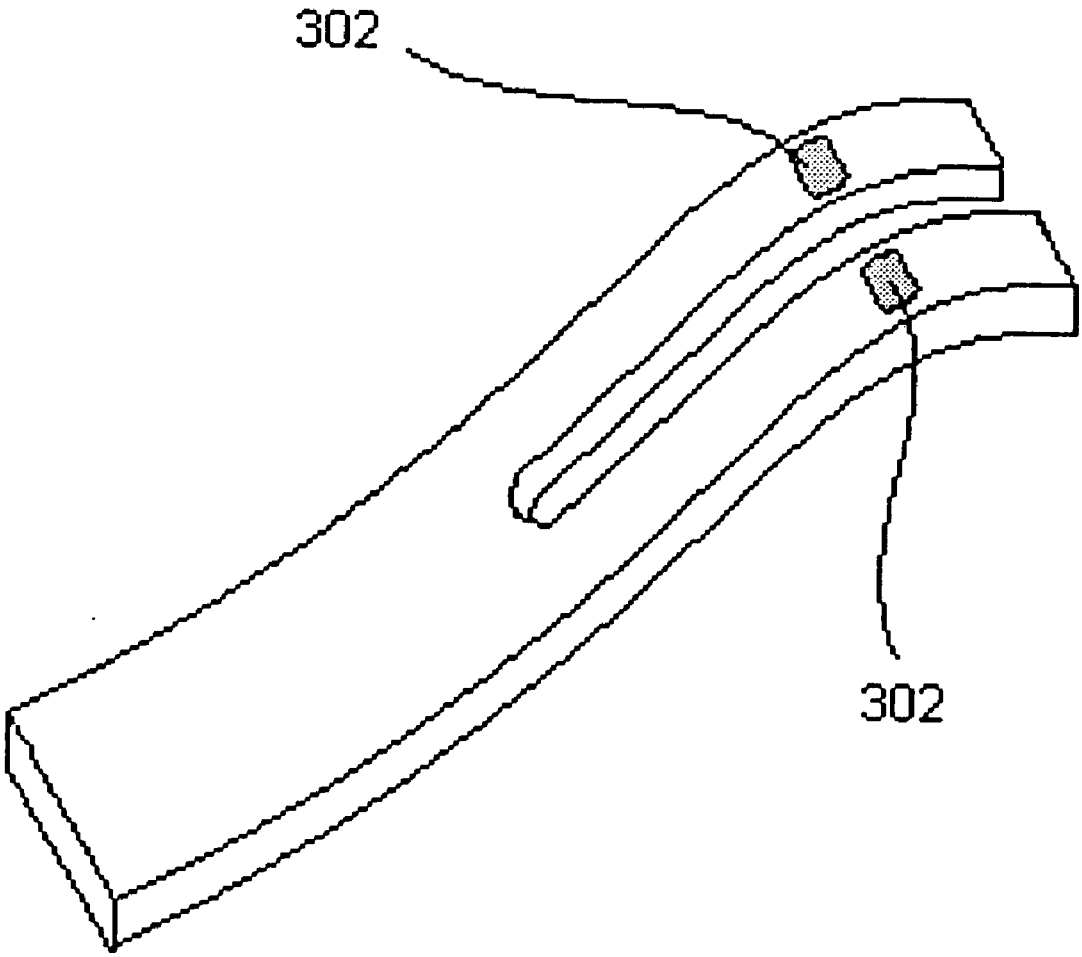
FIG. 3 is a projection view of a bifurcated contact from an edge connector.
Figure 4:
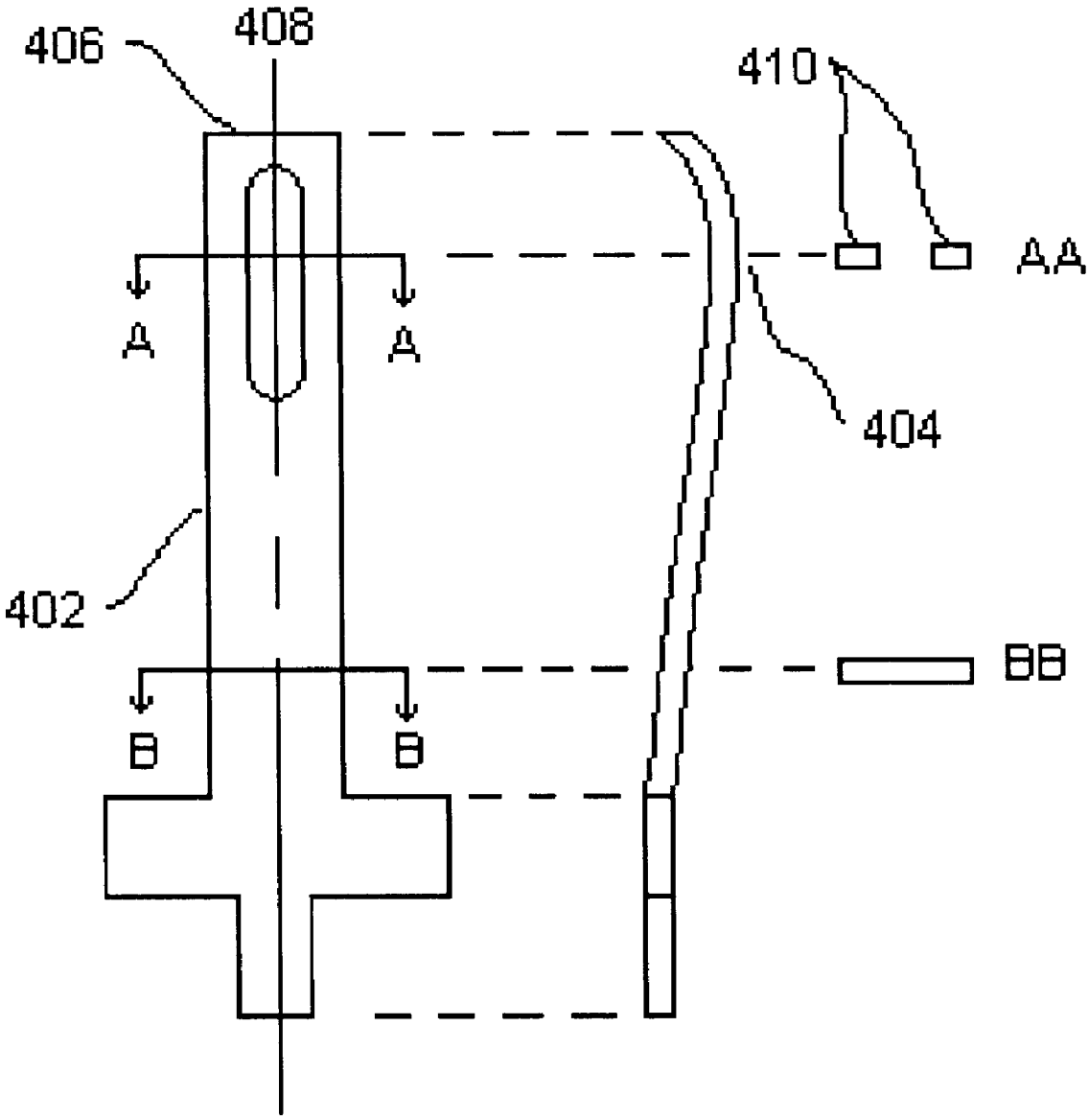
FIG. 4 is a drawing of a bifurcated contact with a connecting member at the tip of the contact in accordance with the present invention.

An edge connector with multiple redundant contact points that includes a joining member at the tip can withstand the high stress caused by surface imperfections during card insertion. By providing a connector with multiple contacts that can withstand the high stresses caused by surface imperfections, the advantages of multiple contacts can be obtained with a reduction in the risk of contact failure.

In one embodiment of the current invention the contact comprises a curved main beam (402). The main beam is curved to create a contact area (404). The curving also provides sufficient normal force to ensure a reliable connection at the contact area. The contact area is bifurcated to create two contact points (410). Finally the end of the main beam has a joining member (406) that connects the two parts of the bifurcated beam. The joining member fully encloses the opening that bifurcates the contact area. In the preferred embodiment the shape of the fully enclosed opening (412) is a slot. A slot is an opening where the ends of the opening are rounded.

The contact functions as follows: When the contact points (410) encounter surface contamination or debris on the plated area or pad of the daughter card, the main beam twists around axis 408 allowing both contact points to maintain a connecting force. When an extreme downward force along axis 408 is generated by insertion of a card with localized surface imperfections, the joining member (406) spreads the load between both bifurcated beams. This allows both bifurcated beams to carry the vertical loading, greatly reducing the tendency of one beam to fail under the high localized force.

Figure 5:
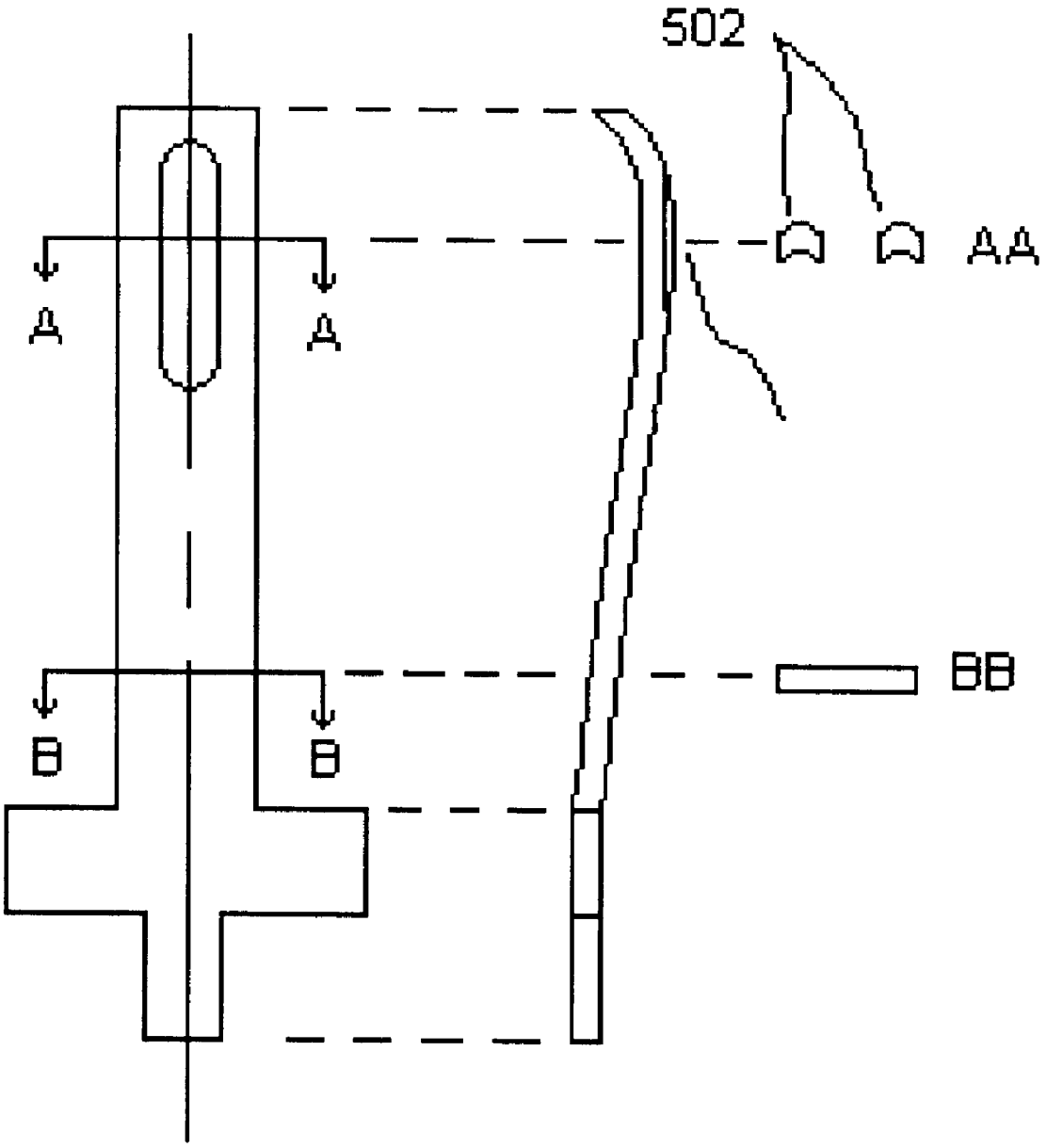
FIG. 5 is a drawing of a bifurcated contact, shaped to produce a curved cross sectional shape in the two contact areas, with a connecting member at the tip of the contact in accordance with the present invention.

The contact pressure of the contact points can be adjusted by changing the cross sectional shape in the contact area. A flat shape (410) would tend to maximize the contact area and produce the lowest contact pressure. A curved shape (see FIG. 5) would tend to minimize the contact area and produce high contact pressure. The two contact areas (502) in the connector can be coined or stamped and formed to produce a curved or hemispherical cross sectional shape in the contact areas (502).

The foregoing description of the present invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A multiple redundant contact, comprising:

a beam, the beam having a first end and a second end and a width, the beam is curved to form a contact area near the first end;

the beam forms at least one fully enclosed opening that divides the contact area into at least two parts;

the second end of the beam is directly attached to a retaining tab, the retaining tab is wider than the beam;

the fully enclosed opening ends before the fully enclosed opening reaches the second end of the beam.

2. The multiple redundant contact of claim 1 where the parts of the contact area are of approximately equal size.

3. The multiple redundant contact of claim 1 where the beam forms a fully enclosed opening in the shape of a slot.

4. The multiple redundant contact of claim 1 where the contact area is approximately flat.

5. The multiple redundant contact of claim 1 where both contact points are approximately hemispherical.

6. The multiple redundant contact of claim 1 where the beam produces a high normal force.

7. The multiple redundant contact of claim 1 where the beam produces a low normal force.

* * * * *